United States Patent [19]

Coles et al.

[11] 4,427,108

[45] Jan. 24, 1984

[54] STACKABLE DISPLAY UNIT

[75] Inventors: Robert E. Coles, Leamington Spa; Douglas R. Compton, Chalfont St. Giles; Jack Lawrence, Dartford; William A. Carpenter, Aveley, all of England

[73] Assignee: General Foods Limited, Banbury, England

[21] Appl. No.: 351,802

[22] Filed: Feb. 24, 1982

[51] Int. Cl.[3] ..... B65D 5/48; B65D 25/04; B65D 71/08

[52] U.S. Cl. ..... 206/44 R; 206/45.33; 206/45.34; 206/497; 229/42

[58] Field of Search ..... 206/44 R, 45.15, 427, 206/45.33, 45.34, 45.31, 497; 229/27, 42

[56] References Cited

U.S. PATENT DOCUMENTS

| | | | |
|---|---|---|---|
| 2,027,079 | 1/1936 | Weiss | 206/45.15 |
| 2,318,957 | 5/1943 | Morris et al. | 206/427 |
| 3,245,527 | 4/1966 | Martin | 206/427 |
| 3,425,544 | 2/1969 | Ayer et al. | 206/45.33 |
| 3,826,357 | 7/1974 | Roth | 206/45.33 |

FOREIGN PATENT DOCUMENTS

| | | | |
|---|---|---|---|
| 1444032 | 5/1966 | France | 206/45.31 |

*Primary Examiner*—William T. Dixson, Jr.
*Assistant Examiner*—Brenda J. Ehrhardt
*Attorney, Agent, or Firm*—Joyce P. Hill; Thomas R. Savoie; Daniel J. Donovan

[57] ABSTRACT

A display unit comprising an elongated tray with walls which define a region accommodating a batch of sachets, the tray including longitudinal side walls with inwardly turned parts at each end, the said parts being capable of providing support for another display unit placed above.

3 Claims, 2 Drawing Figures

STACKABLE DISPLAY UNIT

DESCRIPTION

TECHNICAL FIELD

This invention relates to a stackable display unit containing malleable items of which sachets are typical. It is desirable to attempt, though much more difficult to provide, the packaging of a batch or batches of sachets in display unit which is easy to assemble and disassemble, provides resistance to the compression of the batches in transit, when partly disassembled give a readily visible display and allows the display units to be stacked one on top of another to give several layers of units without damaging the enclosed sachets. When known stackable display units having full depth side walls and an 'open' front for sachet removal are stacked usually the base of the upper tray is pushed down between the walls of the lower tray, thus squashing the lower sachets in the process.

The purpose of the present invention is to overcome the above disadvantages and provide a display unit which at least in its preferred embodiments provides the aforementioned benefits.

DISCLOSURE OF INVENTION

According to the invention a stackable display unit comprises an elongated tray with walls which define a region accommodating a batch of sachets the tray including longitudinal side walls with inwardly-turned side parts at each end, the said parts being capable of providing support for another display unit placed above.

There follows a description by way of example of one embodiment of the invention which reference to the accompanying drawings in which.

The particular embodiment which is shown is a display unit for, in this example, one batch of sachets which may contain comestibles, confections, cosmetics or such like. As will be made apparent hereinafter, the particular embodiment may be adapted to accommodate only a single batch or two or more than two batches.

The main purpose of the display unit is to provide an easily visible display, to enable one display unit to support another, even after the one unit has been partly disassembled for the purpose of display, without damage to the sachets and also when the unit is wrapped to render the batch or batches secure and safe for transport and particularly to protect against compression.

Figure 1:
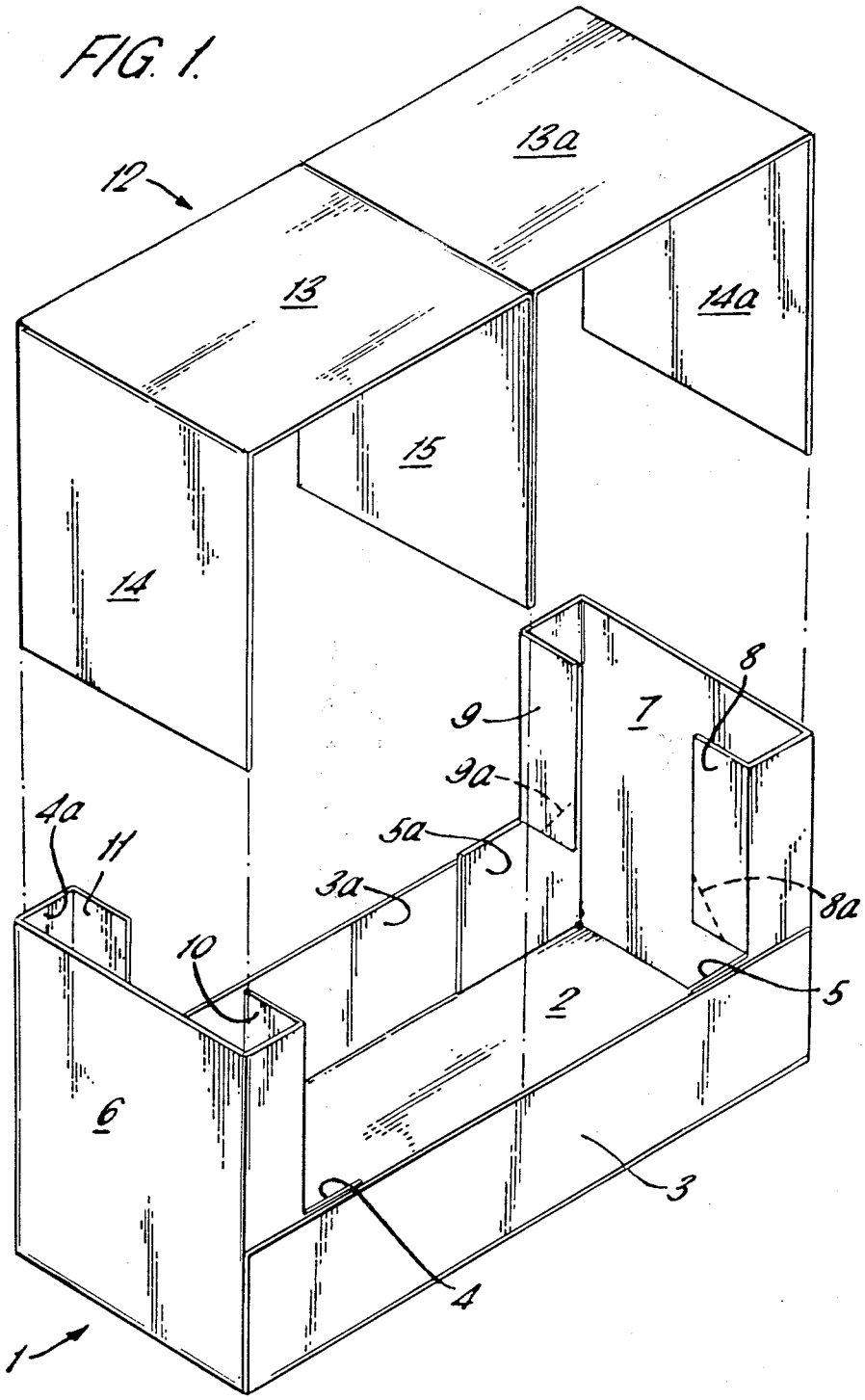
FIG. 1 illustrates various component parts of the display unit.

FIG. 1 illustrates the components other than the sachets and outer film of wrapping. The unit 1 may be for the most part composed from a blank. Said blank when folded forms a tray comprising a single base part 2, longitudinal side walls 3 and 3*a* which may be single or at least partly double walls formed by side flaps 4, 4*a*, 5, 5*a* overlapping with and effectively forming part of the longitudinal side walls 3 and 3*a* and front and rear walls 6 and 7 which are preferably substantially higher than the longitudinal side walls 3 and 3*a*.

In this embodiment the side flaps 4, 4*a*, 5, 5*a* are slit laterally at a height the same as that as the longitudinal side walls, 3 and 3*a* and to a width approximately half that of the flap. It will be appreciated that even 20 mm (vertical depth) of a 200 mm high flap would enable that tab to provide support to a display unit placed on the top thereof while at the other extreme the complete vertical depth of flap would also be satisfactory. The tabs, 8, 9, 10, 11 thus formed are turned inwards, giving support to another package stacked on top of the unit. The effective top surface area of the display unit bounded by the front and rear walls (6 and 7) is significantly smaller than the base of the package which is placed on the top thereof. For example, a notional surface area of about 20% of the total base area of the display unit has been found to be effective. The tabs 8, 9, 10 and 11 may be turned inwards at any angle.

Additionally, the turned in tabs 8, 9, 10 and 11 may be creased along the lines which are marked 8*a* and 9*a* in FIG. 1. These lines are not visible on tabs 10 and 11 in FIG. 1. The corner portion may then be turned backwards after the display has been loaded with sachets. This avoids a sharp point or edge puncturing a sachet. Alternatively the same effect may be obtained by cutting out the corner portion during the manufacture of the display.

The tray 1 constitutes a holder for one or more horizontal batches of sachets. It is capable of supporting the batches or each batch within a respective region delimited by the front and rear walls. It may also be made from more than one piece with detachable front and/or rear walls 6 and 7 which can be removed when stacking is not required. Furthermore, one or more of the side walls of the tray may taper upwardly, the tapering effect being achieved by appropriate cutting and assembly of the blank.

For each batch of sachets there is a cover 12. Each cover may be made, as is the tray, of double faced corrugated or solid paperboard and may also be, for the most part composed from a blank having appropriately positioned lines of weakness.

The cover 12 is composed of two sections 13 and 13*a* which are separated by a double central wall 15 formed by folding the central portion of the blank and single side walls 14, 14*a* of the same height as the central wall.

The central wall divides the package in two halves which is a useful feature for grocery wholesalers whose customers cannot always afford a complete case. This especially appears where many different flavors of the same product are involved. The two halves can be separated safely and easily by cutting down through the divider, traywalls and base. The knife being kept out of contact with the sachet throughout.

Each cover section in the assembled package fits over the respective batch of sachets and the side walls of the cover and abut the base of the tray. The side walls overlap and preferably fit within one of the respective walls of the base so that movement of the cover, and the batch of sachets it contains, over the base of the tray is limited.

The central wall also abuts the base of the tray giving the cover more stability and in combination with the close fit of the sachets with the sides of the base prevents the sachets sliding forwards. The presence of the corners of front wall (6) likewise prevents sachets toppling forward.

Figure 2:
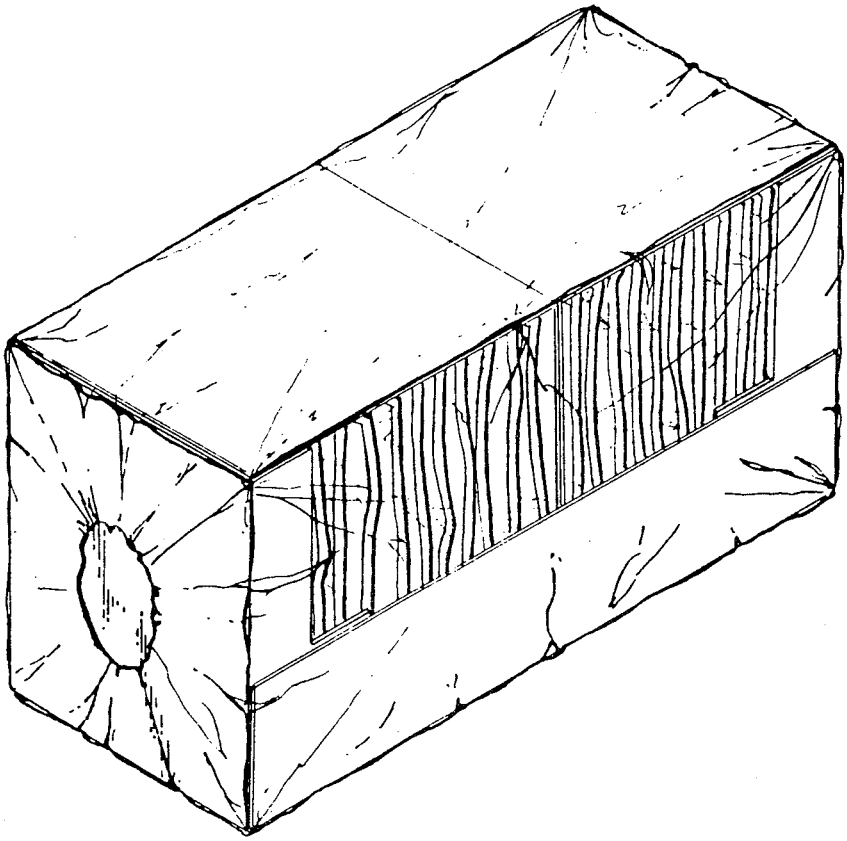
FIG. 2 illustrates a three quarter view of the display unit wrapped.

When the display unit shown in FIG. 2 is to be disassembled the outer film or other bonding means, if provided, is removed and the bonding means or each cover is lifted away from the tray to leave the batch of sachets in position.

Various modifications can be made to the described embodiment without losing the benefits of the invention. For example if the tray is to contain two batches it would be made twice as wide as is shown in the drawings, the batches being disposed parallel to each other. A divider may be included between the rows if desired. The cover and divider would be slotted at their appropriate points of intersection to allow the two to be combined.

The heights, both absolute and relative of the various walls may also be altered as well as the height at which the side flap is slit laterally and the depth of the incision. In addition the front wall 6 may have a section of any shape removed or removable to allow the first socket in the tray to be visible and indicate the contents of the tray conveniently. Various other cutouts may be provided in the walls of the tray and cover in accordance with ordinary practice.

What is claimed is:

1. A display unit composed from a blank comprising an elongated tray with walls which define a region accomodating a batch of sachets, said blank when folded forms a tray comprising a single base (2), longitudinal side walls (3,3*a*) which are partly double walls formed by side flaps (4,4*a*,5,5*a*) overlapping with and effectively forming part of the longitudinal side walls (3,3*a*) and front and rear walls (6,7) which are higher than the longitudinal side walls (3,3*a*), the side flaps (4,4*a*,5,5*a*) have lateral slits at a height the same as that of the longitudinal side walls (3,3*a*) and to a width approximately half that of the flap, said flaps when turned inward form tabs (8,9,10,11), said tabs being capable of providing support to another display unit placed above.

2. A display unit as claimed in claim 1 in which a cover having a double central wall (15) fits over the batch of sachets and abuts the trays so as to enclose the sachets, said double central wall prevents the sachets sliding forward.

3. A display unit as claimed in claim 1 in which the tray is made from a plurality of parts with the front and/or rear walls being removable when stacking is not required.

* * * * *